US008371802B2

(12) United States Patent
Udall

(10) Patent No.: US 8,371,802 B2
(45) Date of Patent: Feb. 12, 2013

(54) SHAFT STABILISER

(75) Inventor: Kenneth F. Udall, Ilkeston (GB)

(73) Assignee: Rolls-Royce PLC, London (GB)

( * ) Notice: Subject to any disclaimer, the term of this patent is extended or adjusted under 35 U.S.C. 154(b) by 800 days.

(21) Appl. No.: 12/585,093

(22) Filed: Sep. 3, 2009

(65) Prior Publication Data

US 2010/0158421 A1 Jun. 24, 2010

(30) Foreign Application Priority Data

Oct. 24, 2008 (GB) ..... 0819485.4

(51) Int. Cl.
*F01B 25/26* (2006.01)
*F01B 25/16* (2006.01)
*F01B 25/14* (2006.01)

(52) U.S. Cl. ..... 415/9; 415/119; 384/129

(58) Field of Classification Search ..... 415/116, 415/118, 119, 9, 229, 216.1, 58.1, 58.2; 60/39, 60/91, 223, 796, 799; 464/180; 384/12, 384/194, 195, 185, 252, 295, 441
See application file for complete search history.

(56) References Cited

U.S. PATENT DOCUMENTS 6,009,701 A * 1/2000 Freeman et al. ..... 60/223

FOREIGN PATENT DOCUMENTS

GB 2 320 526 A 6/1998

* cited by examiner

*Primary Examiner* — Justine Yu
*Assistant Examiner* — Woody A Lee, Jr.
(74) *Attorney, Agent, or Firm* — Oliff & Berridge, PLC

(57) ABSTRACT

A load transfer arrangement is provided to act as a stabiliser for utilisation in centring rotational instabilities which may occur in rotor devices such as those within a gas turbine engine. By providing a fixed screw thread path which comprises a groove having channels and having constrictions and which define clearance crowns an acceptable eccentricity range it is possible to slow screw thread driving motion and therefore load transfer only to the positions where the rotational eccentricity enters tapers leading to the constrictions. In such circumstances an orbit thread is then progressively brought into confinement and continuous engagement with a fixed screw thread defined by crowns of channels of the fixed screw thread path defined by the continuous groove through the channels. In such circumstances wide eccentricity is allowed initially but as rotational speed reduces greater and more continuous driving motions are provided whilst avoiding excessive loading during early stage operation. High loads on final rundown contact are controlled by a diaphragm mount, the whole serving to restore the support stiffness of the rotor post fusing.

11 Claims, 7 Drawing Sheets

SHAFT STABILISER

The present invention relates to shaft stabilisers and more particularly to shaft stabilisers which utilise a screw-in-device with regard to rotors about a shaft in a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 130.

In view of the above it would be appreciated that the rotor elements in the form of blades are supported upon a shaft which rotates within the engine 10. In such circumstances in the event of a fan blade suffering damage which places it significantly out of balance there will be considerable radial loads transmitted to the shaft and subsequently to the engine core itself. In order to protect the engine core from being seriously damaged by such radial loads typically an appropriate fuse device is utilised with a shaft stabilising mechanism. The fuse device is typically frangible and arranged to fracture and shear when subjected to loads above a predetermined magnitude. After the fuse has been activated a shaft stabiliser mechanism is operative in order to control the instability created by fan out of balance radial loads. Such stabilisers and means for control of radial loads as a result of imbalance include screw-in devices.

An example of a screw in device is provided by U.S. Pat. No. 6,009,701. Generally, a fixed conical screw thread path is provided along which a single turn orbiting conical screw thread passes in order to center the orbit thread and therefore the bearing carrier. Generally, in operation the fuse is activated to release the bearing carrier and orbit thread such that the orbit thread will move along a tapering screw thread path in order to provide centring as well as control of radial loads. The orbit thread will roll along the fixed screw thread path and being of smaller circumference, will precess, and screw down that path until the gap is closed and the bearing or shaft re-centered. In order to achieve such control it will be appreciated that the fixed screw thread path is generally conical and in such circumstances a depth of centring must be provided within the stabiliser arrangement, from an initial clearance to allow for the initial orbit.

The necessary depth for centring causes significant problems when larger instability orbits and when high energies are considered. It will be understood that for larger instability orbits the gaps must be greater and that these gaps are additive in that a depth of centring must be provided outboard of the cylindrical bearing to fixed screw thread bore orbit clearance, which in turn is outboard of the front bearing housing to fan shaft orbit clearance. Parallel to this, there is typically a slot, with an appropriate guide member, to guide the arrangement in use. Such enlarging of the size and weight of screw in devices render them less acceptable for large gas turbine engines. A further consequence is that large gaps produce an initial gear ratio which is raised due to the larger differences in fixed and orbit thread circumference and therefore the screw in device advances more rapidly and closes down earlier in the case of an instability event. Such rapid operational close down will result in significant rotor energy being abruptly applied to the stabiliser. Although within reason it is possible to provide slowing of closure by adding more turns to the screw in device, this increases the length and so weight for such extended screw in device stabilisers.

The combination of a larger radius as well as physical size of the necessary threads makes it difficult to accommodate such designs within acceptable space envelopes for a gas turbine engine. Additionally, it will be appreciated that screw in devices can be orbit tolerant while the orbit thread is gripped by a first fixed thread spring turn. In such circumstances the orbit thread crown does not have to contact the root of the fixed thread path in order to roll home. For a high gear ratio as will be present with a large orbit screw in devices such an arrangement results in the first sprung fixed thread being left behind before there is sufficient decay in the fan speed and hence out-of-balance forces to allow safe contact between the crown of the orbit thread and that of the fixed thread. In such circumstances the orbit thread will stop driving resulting in continuous unrestrained orbit of the fan, uncontrolled by the screw-in-device.

In accordance to aspects of the present invention there is provided a shaft stabiliser for a gas turbine engine comprising a fixed screw thread path at least tapering in part and an orbit thread centering a bearing carrier fixed to a bearing housing, the orbit thread is configured to move along the fixed screw thread path to center the bearing carrier relative to the engine axis, the stabiliser characterized in that the fixed screw thread path is defined at least in part by a channel with a rising constriction and the orbit thread includes spring finger ends to engage the fixed screw path, the constriction extends along the fixed screw path to act within the channel against the spring finger ends of the orbit thread to vary engagement load to the orbit thread dependant upon its radial and axial position along the fixed screw thread path.

Generally, a guide flange is associated with the bearing carrier and the guide flange is provided within a radially tapering slot formed between the fixed thread and a diaphragm mount in order to draw the orbit thread down the conical fixed thread and along the plain bearing surface as it rolls and precesses.

Generally, at least a part of the fixed screw thread path is arranged to provide a continuous load engagement to the orbit thread by constriction of the spring fingers of the orbit thread. Beyond the constriction, to the crowns 60, 61, 62 of the first second and third turns of the fixed thread, there is a parallel portion of the fixed thread, which does not constrict the spring fingers of the orbit thread, and thus allows the orbit thread to orbit without rolling and precessing. Thus the orbit thread thus does not 'drive home' during large orbits, and operation of the device is slowed.

Generally, the stabiliser incorporates a fuse element to restrain the bearing housing. Typically, the fuse element is activated by an excess shear load produced by the initial blade off event Also in accordance to aspects to the present invention is provided a gas turbine engine incorporating a stabiliser as described above.

Aspects of the present invention will now be described by way of example and with reference to the accompanying drawings in which:

FIG. 1 is a schematic section of part of a gas turbine engine;

FIG. 2 provides a part cross section of a stabiliser in accordance with aspects of the present invention prior to deployment;

Figure 1:
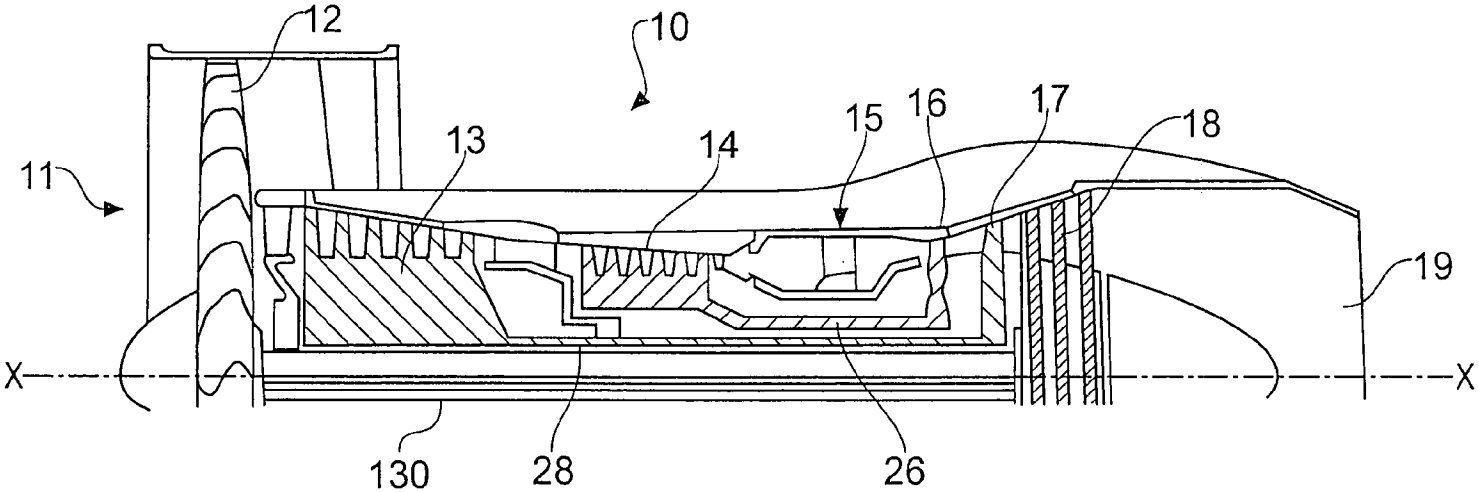
Figure 2:
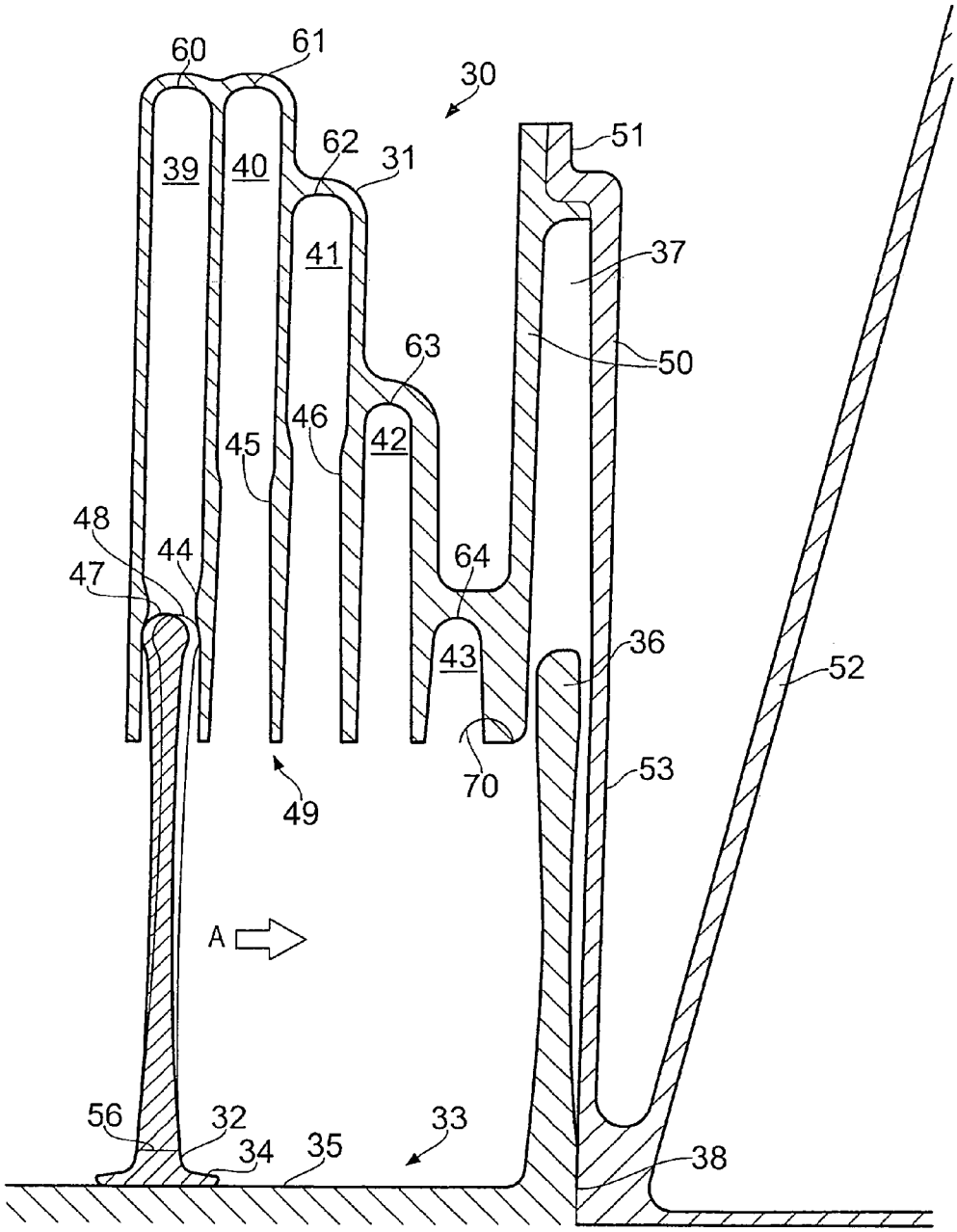

As depicted in FIG. 2 a stabiliser 30 comprises a fixed screw thread path 31 for an orbit thread 32 and a bearing carrier 33. The orbit thread 32 also includes a plain bearing surface 34 which engages a reciprocal plain bearing surface 35 associated with the bearing carrier, which also features a guide flange 36 within a guide slot 37. In operation typically a fuse will be provided in the region 38 to hold the bearing carrier 33 in position to the bearing housing 52 unless an excessive load is applied. As indicated previously the excessive load will typically be as a result of instability created by a blade failure in a rotor associated with the stabiliser 30. The fuse in the region 38 will prevent operation as described below unless an excessive unbalancing radial load is applied.

The screw thread path 31 comprises a number of channels 39, 40, 41, 42, 43 which least in part define the conical or tapering fixed screw thread path 31 for the orbit thread 32 in the direction of arrowhead A. It is this conical or tapering path which through the bearing surfaces 34, 35 will re-center and provide stabilisation in accordance to aspects of the present invention.

As indicated above generally the channels 39, 40, 41, 42, 43 have crown parts 60, 61, 62, 63, 64 and constrictions 44, 45, 46. In such circumstances the respective crown parts and constriction parts define a rising tapered driving path outboard of which is wider parallel non-tapered non-driving path within the stabiliser 30. Thus, there is effectively pinching together of the bulbous fore finger ends 47 and aft finger ends 48 upon the orbit thread 32 as these ends move along the tapered path inboard of the constriction. The first turn of the thread defined between paths 39 and path 40 is flat crowned to allow adequate crown clearance between the fixed and orbit threads 31, 32 until the rotor orbit decays. During this early stage of the unbalanced event the orbit is very eccentric and therefore only a small proportion of the orbit is spent at a low radius, in the driving taper portion. Moreover, the small radius, with side driving of the spring finger ends, implies a low gear ratio. The speed of orbit thread advance in the direction of arrow A is thus very slow giving adequate time for the blade-off orbit and windmill energy to decay. If less blading is lost, and the orbit is smaller and less energetic, the orbit thread will still spend a significant time in the low radius tapered driving part of the groove, and hence the device will still 'drive home' at an adequate rate.

The splay of the finger ends 47, 48, is such that outboard of constrictions 44, 45, 46, the finger ends are in light sliding contact with the parallel groove walls 39, 40, 41. The high radius portions of the initially very eccentric orbits are spent in these non-driving regions, and hence these portions do not advance orbit thread 32 in the direction of arrow A.

Note that a positive aspect of the large orbits for which this device is sized is that there is of necessity a large radial distance between bearing surface 35 and the bore 49 of fixed thread 31. To ensure that orbit thread 32 finger ends 47, 48 overlap bores 49 by a sufficient margin to retain more than 180° of orbit thread 32 within grooves 39, 40, 41, 42, 43 at large orbits, and thereby retain operating pitch and yaw stability of orbit thread 32 within fixed thread 31, finger ends 47, 48 lie outboard of bores 49 when centered as shown in FIG. 2. There is thus significant finger bending length provided between finger ends 47, 48 and the finger roots 56. This length gives a sufficiently low finger end pinch bending stiffness with a low finger bending stress.

The slot 37 for the guide flange 36 as indicated provides a controlling action with respect to initial contact loading due to the offset couple from initial contact close to crown 63 (note thicker crown section) to the plane of diaphragm mount 53 causing diaphragm tipping to soften the initial contact force. The wall sections 50 as indicated are tapered to minimise pinch closure whilst retaining diaphragm mounting behaviour through a diaphragm spring wall 53 which forms part of the slot 37. Orbital movement as a result of radial loading will result as indicted in the flange 36 further entering the slot 37 thus causing the spring finger ends 47, 48 to move beyond the constriction 44 in channel 39. In such circumstances as indicated above the spring finger ends can oscillate within the channel 39 above the constriction 44. At the other side of the device, the spring finger ends will be withdrawn from the taper to constriction 44, and at large orbit deflections will enter the free space between bores 49 and bearing 35.

Aspects to the present invention allowing large radial clearances to be provided to accommodate for large eccentric orbits as a result of unbalanced loads presented to the bearing carrier 33, and so to the orbit thread 32 and in particular the spring finger ends 47, 48 within the channels 39 to 43. Aspects to the present invention utilise a configuration whereby in a relaxed state in respect to the sprung ends 47, 48 there is no side force created by the sprung ends 47, 48 against surfaces of the channels 39, 40, 41 so no driving force whilst in the uncompressed regions. However in the taper regions leading to the constrictions 44, 45 and 46 there is a driving force which is tolerant to rotational orbit size. The first channels 39 to 41 as indicated include the constrictions 44, 45, 46 leading to non-driving sections to the crowns 60, 61, 62. The last channels 42, 43 define a tapering or cone centring of the orbit thread 32 such that there is a centring force presented by contact of the crowns 63, 64 against the finger ends 47, 48 and thence via the orbit thread 32 through the bearing surfaces 34, 35. Thus, there is compression engagement of the bearing surfaces 34, 35 to a centring effect as described. The orbit thread 32 will present a compressive force for centring the element to which the bearing surface 35 is attached. This compressive force will as indicated provide a large down force on the bearing surface 35. This down force may be limited by the diaphragm 53 deforming under the off set load couple presented through the stabiliser 30. As the orbit thread 32 approaches final centring in the last channel 43 it will be understood that a load is presented through the crown 63, 64 portions of the channels 42, 43. These crown portions 63, 64 also define the fixed thread cone angle by which the orbit thread 32 rides to progressively apply centring. The diaphragm 53 oscillation swash thus reduces and the arrangement therefore stiffens to maximise center bearing support stiffness towards the end of the fixed screw path.

As indicated above generally the stabiliser 30 in accordance with aspects of the present invention provides positive orbit tolerant but slowed re-centring of a bearing carrier, fused as a result of an unbalance such as with regard to a blade failure in a rotating assembly within a gas turbine engine. An object is to await the eccentric orbit reduction that occurs timewise with speed reduction. In accordance with aspects of the present invention as there is decay in speed the contact loads will also be controlled to acceptable levels resulting in a stabiliser which can operate within acceptable parameters.

A problem with regard to utilisation of a diaphragm 53 is that on initial orbit thread to crown contact the offset load couple causes the fixed screw thread path 31 to move in the same direction as arrowhead A at the contact load angular plane. Such distortion will close the guide slot 37. In order to avoid problems with regard to operation of the stabiliser 30 a clearance as shown between the slot 37 and the guide flange 36 is required. Without such a clearance it will be understood that gripping of the flange 36 within the slot would occur effecting the driving orbits of the orbit thread 32 in the channels 42, 43. There is also some risk in channels 39, 40, 41 although prior to crown contact near to crown portion 63 the finger end forces are relatively low. It will also be understood that there is a risk of high loads close to the plane of the diaphragm mount 53. In order to minimise slot 37 closure and also free play rattle on the guide flange 36 as illustrated the slot 37 is stiffened by tapering towards an outer mounting flange 51 where the fixed thread 31 is fixed to the mount 53.

As indicated above rapid deployment can be a problem with respect to stabilisers. Rapid deployment will mean rapid application of radial loads which can cause stress and other problems. Aspects of the present invention attempt to avoid such rapid deployment. Aspects of the present invention utilise aspects of the behaviour of unbalanced orbits. These unbalanced orbits are loop shaped rather than circular. Initially orbits contain off center loops which will not drive the stabiliser 30 and so will delay early orbit screw thread axial movement in the direction of arrowhead A.

It will be appreciated that there may be large orbits as well as small orbits or a combination of such orbits in an unbalanced scenario which requires stabilisation in accordance with aspects of the present invention. It will be appreciated that such loop orbits are as a result of the unbalance and lack of symmetry with regard to the rotating component to be stabilised and to the decaying impulse nature of the unbalance event. It will be understood in such circumstances that blade off events which generally will cause unbalance are very variable and large orbit radius driving will not work for partial blade loss. It will also be understood that driving engagement by the orbit thread 32 with the fixed screw thread path 31, defined by the channels 39 to 43, results in a requirement that the engagement or wedge angle is large enough to confine the driving sector to a small angle about the radial orbit excursion direction, for that portion of the orbit whose radius lies within the constriction radius 44, 45, 46, and after this at the crown contact radius 63, 64. Thus the driving sector of each orbit is less than or equal to 360° but for grooves 39, 40, 41 this will be the slowest sector for driving of the orbit and therefore the orbit thread 32 in the direction of arrowhead A.

In the above circumstances as can be seen the stabiliser 30 is configured such that low orbit radiuses drive the stabiliser 30 during initial high eccentricity orbit phases. As illustrated channel 39, channel 40 and channel 41 each include a relatively large displacement head between the respective constriction 44, 45, 46 and crown parts 60, 61, 62. Such an approach means that the stabiliser 30 can cope with large orbit eccentricities whilst still providing a driving effect for a minor and therefore lower orbit eccentricity. Furthermore smaller orbit radiuses provided by engagement with the constrictions 44, 45, 46 ensure that the selected driving sector for the eccentric orbit has a relatively low gear ratio and so advance in the direction of arrowhead A is slowed by low gear ratio and by the smaller proportion of each orbit which is driving. It will be understood that it is only when the spring finger ends 47, 48 engage with the tapers leading to constrictions 44, 45, 46 that a driving motion in the direction of arrowhead A will be provided. Whilst the spring finger ends 47, 48 are above the constriction 44, 45, 46 in the channel 39, 40, 41 advancement in the direction of arrowhead A will not occur.

With regard to FIG. 2 it will be noted that the first restriction 44 is at a relatively low radial height. In such circumstances the spring finger ends 47, 48 will be within the channel 39 above the constriction after the spring finger ends 47, 48 are released beyond the constriction 44. In such circumstances during initial high energy, high fan speed, very eccentric large orbit movements most of the orbit is beyond the drive throttle created by engagement between the spring finger ends 47, 48 and the constriction 44. Thus, advance in the direction of arrow A is slow. Crowns 60, 61 lie beyond the largest predicted orbit to avoid contact. Thus, heavy loads are not applied.

As the unbalance event progresses it will be understood that the speed of rotation will decay and as the initial impulse decays the orbit will become less eccentric. A less eccentric orbit will reduce the maximum orbit radius whilst the minimum orbit radius increases resulting in a mean orbit stabilisation. In such circumstances the constrictions 44, 45, 46 define a screw thread path such that the spring finger ends 47, 48 progress along the first thread defined by the constriction 44 and onto the second thread defined by the constriction 45. It will be noted that the constriction 45 defines a driving ramp which although centerd has a drive throttle which is much further up the channel 40 to ensure that a higher minimum orbit does not take the driving element 32 into a non driving section such that it ceases to wind in the direction of arrowhead A. As indicated as speed deteriorates generally the orbit of the spring finger ends 47, 48 as a result of the unbalance will become more circular such that driving occurs over a larger section of rotation and so a larger proportion of orbit time. Such greater driving over a larger sector of engagement is offset by the decay in rotor speed with time. Nevertheless, generally the stabiliser 30 through the later stages will advance more quickly and possibly twice as fast as during other earlier phases of deployment of the stabiliser 30 in accordance with aspects of the present invention.

As rotational speed further slows, and for a low flight speed event, it will be understood that rotor speed will have dropped into resonance with the unbalanced fan bounce frequency and hence the orbit changes will run from inverted that is to say about a center of mass to running "heavy side out" about the stiffness of the fused shaft system.

As the arrangement moves into resonance the maximum orbit radius will increase dramatically. In such circumstances it is necessary as depicted to maintain a crown height 61 in the channel 40 which is sufficient to accommodate such orbit eccentricity whilst avoiding crown 61 and the crown 62 contact. The maximum orbit radius will decay fairly rapidly and then slowly as the orbit eccentricity decays and the orbit becomes more circular as the fan speed drops below the resonance speed. The minimum orbit radius increases by about 20% through resonance and then slowly decays. At this point it will be appreciated there is a significant risk of temporary loss of driving motion in the direction of arrowhead A.

In such circumstances there is a rapid increase in constriction height between constriction 44 and constriction 45.

After resonance with respect to rotation a maximum orbit eccentricity reduction allows a reduction in channel 41 crown height 62 such that driving into a centring function is achieved and begins as channel 41 leads into channel 42. The channel 41 is a groove which shows a further small increase in constriction 46 height as the driver motion in the direction of arrowhead A increases. This increase in height between constriction 45 and constriction 46 is relatively small and is utilised again to increase the contact time and therefore driving period in contact to offset the continual reduction in rotational speed. By channel 42 the rising radius of the constriction 46 has met the falling radius of the crown 63 and hence spring fingers 47, 48 are now fully constricted at the crown 63. Generally, the spring finger ends 47, 48 are in continuous engagement with a crown part 63 starting approximately with the fourth channel 42. In such circumstances during this final phase there is an extremely high contact load through the orbit thread 32 upon the bearing surface 35. Nevertheless, through use of a diaphragm mount 53 in accordance with aspects of the present invention there is a reduction in this contact load. The lower orbit radius driving allows a reduction in the length of the screw thread path and consequent weight and costs as well as accommodation space reductions.

By aspects of the present invention initial contact loads are reduced by the provision of effectively a wide eccentricity accommodating head between the constriction 44 and the crown 60 in the first channel 39 whilst by positioning of the constrictions 44, 45 as rotational speed reduces and more circular orbits are created the ramp effective between the constriction 44 and the constriction 45 increases the proportion of driving sectors, that is to say engagement between the spring finger ends 47, 48 and the constriction running along the screw thread path 31 defined by the channels 39 to 43. In such circumstances an inner increasing tapered portion to the screw thread path 31 is created by the constrictions 44, 45, 46 in order to progressively receive side contact driving load whilst providing the capability for wide rotational eccentricity through the crown 60, 61, 62 height positions. In such circumstances once the fan speed has decayed to a safe level the spring finger ends 47, 48 will then ride upon the constriction 46 onward into continuous engagement with the crown 63 then the crown 64 of the respective channels 42, 43 to generate a centring bias presented upon the bearing surface 35.

Although the final "roll in" of the crown 63, 64 engagement between channels 42, 43 appears to be steep as depicted in FIG. 2 it will be appreciated that there is a long circumferential path defined by the groove between the channels 42, 43. This gradient in such circumstances will be generally quite gentle and typically in the order of 1:50. Nevertheless, there will be a side gripping from the orbit thread finger ends 47, 48 effect which will stop the orbit thread 32 slipping back but even if such slippage should occur it will be appreciated that this will simply slow the final closure and therefore reduce unacceptably high sudden loading to the stabiliser 30 in use.

It will be understood that the channels 39, 40, 41, 42, 43 effectively define a continuous groove as the screw thread path 31. The crowns 60, 61, 62, 63, 64 essentially define an outer spiral screw thread path to accommodate orbit excursions whilst the constrictions 44, 45, 46 define an inner spiral path which in engagement with the spring finger ends 47, 48 provide a driving motion by the orbit thread 32 in the direction of arrowhead A. The outer spiral path and the inner spiral path effectively diverge in a leftwards direction as wedges towards channel 39 and the degree of such divergence defines the potential rotational orbit eccentricity head or range for the spring finger ends 47, 48.

As indicated above the arrangement in accordance with aspects of the present invention is generally around a rotating shaft. In such circumstances the channels 39, 40, 41, 42, 43 will extend as a screw thread groove or path as indicated circumferentially around that shaft. In such circumstances within the channels 39, 40, 41 the sizing in terms of width of the channels 39, 40, 41 will be such that when in the parallel sections the spring finger ends 47, 48 do not engage the channels 39, 40, 41 and so no driving of the orbit thread 32 is created. However, about the constrictions 44, 45, 46 whether converging or diverging a driving force will be created.

The constriction 44 will generally run in the groove towards the crown 61 whilst the constriction 45 will run in the groove of the fixed screw thread path 31 towards the crown 62 to define the converging spiral width available for eccentric oscillations within the stabiliser 30 in accordance with aspects of the present invention. The spring finger ends 47, 48 can oscillate within this diverging spiral and engage for driving motion when in the tapered portions leading to the constrictions 44, 45, 46 until the final constriction 46 leads into a head between the constriction 46 and the crown 63 with continuous engagement by the sprung end 33 and therefore a driving movement until a final channel 43 of the screw thread groove. Generally the final channel 43 of the groove will be a re-centerd groove at the same radius as the orbit thread such that the downward pressure presented through the orbit thread 32 upon the bearing surface 35 will act to finally center the arrangement within the stabiliser 30. The groove will end at a final position 70 which will tend to be near a bottom dead center for an arrangement stabilised by a stabiliser 30 in accordance with aspects of the present invention.

By aspects of the present invention essentially a low orbit radius delayed operation driving approach is taken by the stabiliser 30. Thus rather than the outer orbit engagement causing driving motion it is engagement with the inner constrictions 44, 45, 46 which initially acts to provide centering with a very low radial load transfer until continuous engagement in the channel 42 of the groove by crown contact and constriction of the spring fingers forming most of the orbit thread. In such circumstances the orbit thread 32 can freely orbit until its speed has decayed. Re-centring of the bearing is by progressive driving in the direction of arrowhead A of the orbit thread 32 to cause force inwards on the bearing surface 35 for a re-centring effect.

In comparison with prior arrangements it will be appreciated that aspects of the present invention allow for a much larger eccentric orbit. Furthermore, this eccentric orbit will be more tolerant to orbit variation and allows a slower closure avoiding dramatic operational loads and so reducing internal stresses and loads applied to the rest of the structure.

Weight, size and constructional costs with respect to the stabiliser are reduced for a larger orbit eccentricity and in view of the greater accommodation with respect to orbit eccentricity improved operational reliability should be achieved.

Figure 3:
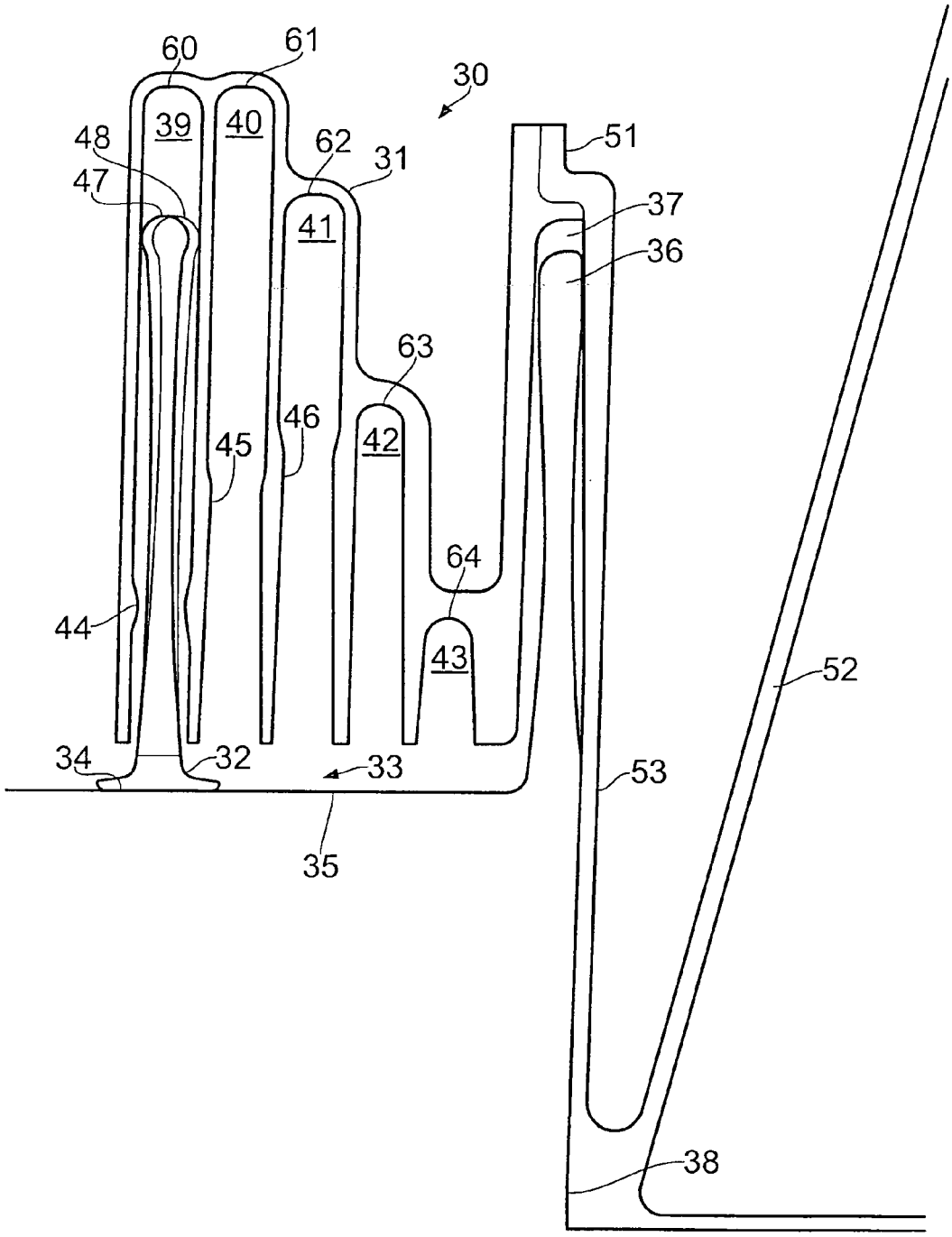
FIG. 3 is a part cross section of a stabiliser as depicted in FIG. 2 at a first stage of deployment.

FIGS. 2 to 7 illustrate the various stages of operation of a stabiliser in accordance with aspects of the present invention. As indicated above the stabiliser operates by movement along an effective screw thread defined by passages 39, 40, 41, 42, 43 which extend about a shaft. These passages 39, 40, 41, 42, 43 incorporate constrictions 44, 45, 46 and crowns 63, 64 such that the orbit thread 32 and in particular the spring finger ends 47, 48 within the passages 39, 40, 41, 42, 43 brings centralisation of the shaft along an eccentric rotation whilst absorbing energy judiciously. In FIG. 3 it will be noted that the orbit thread 32 and in particular the finger ends 47, 48 have passed beyond the constriction 44 and in such circumstances can oscillate in the range between the constriction 44 and the crown 60. (The "space" height shown here between heads 47, 48 and crown 60 is to allow for the increase in radial height of the conical orbit thread 32 from the section shown to the tail of the thread). This gives a wide range of eccentricity in use. The spring finger ends 47, 48 will engage the passage or channel 39 such that typically in the open area as depicted in FIG. 3 there will be no driving effect whilst in contact with the tapers leading to the constrictions 44, 45, 46 or the crowns 63, 64 there will be driving along the path defined by the channels 39 to 43. The first stage of deployment depicted in FIG. 3 generally immediately follows the normal unfused stage as depicted in FIG. 2 prior to operation of the stabiliser in accordance with aspects of the present invention. As can be seen the spring finger heads 47, 48 have extended significantly into the channel or passage 39 as a result of the eccentricity and rotation caused by unbalance of a rotor. Driving essentially is achieved through contact in operation on the sides of the spring finger heads 47, 48.

Figure 4:
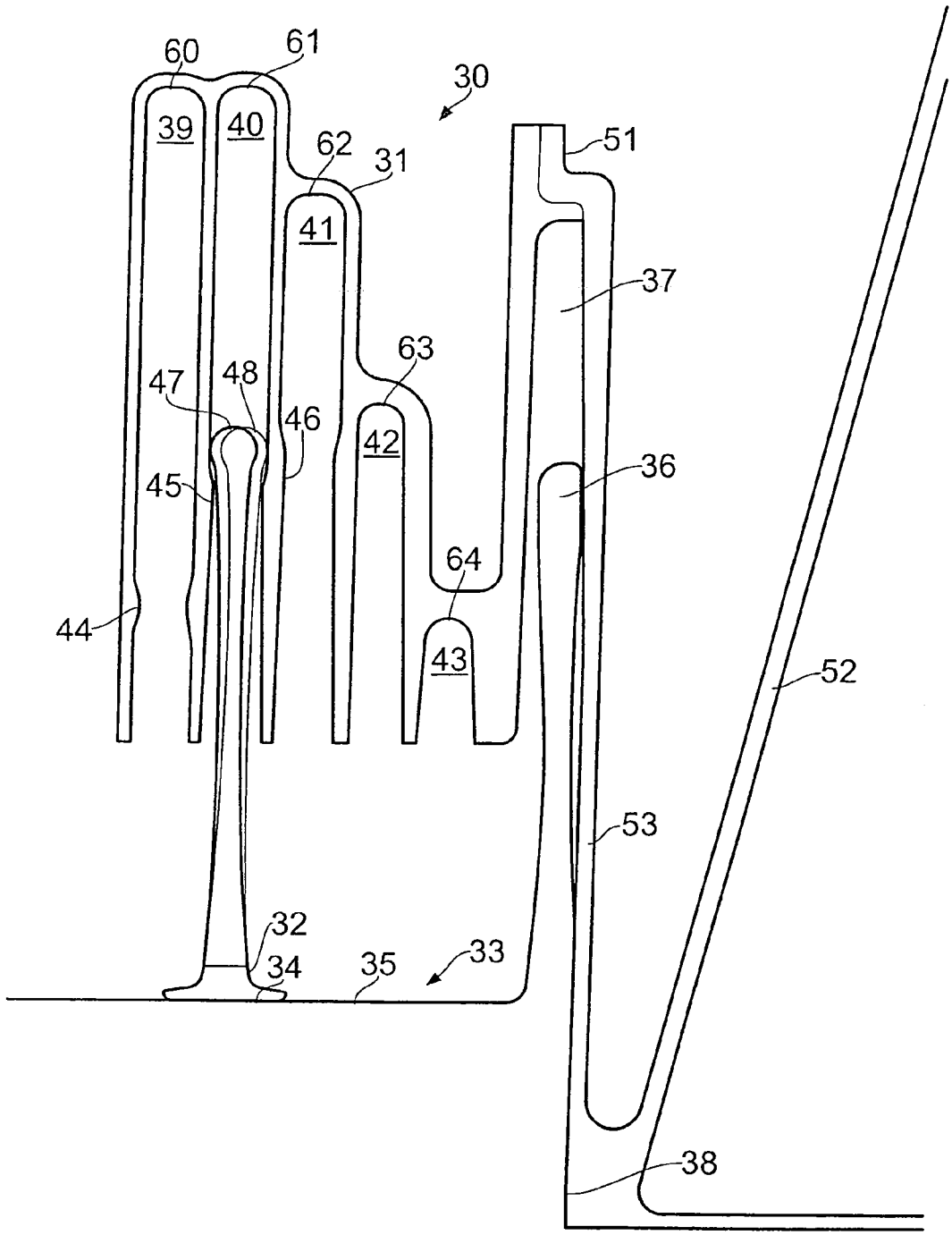
FIG. 4 is a part cross section of a stabiliser as depicted in FIG. 2 and FIG. 3 at a second stage of deployment.

FIG. 4 provides an illustration of a second stage of deployment of a stabiliser in accordance with aspects of the present invention. As can be seen the spring finger heads 47, 48 and therefore the orbit thread 32 has moved from channel passage 39 of the pathway to channel 40. Again the head has the range between the constriction 45 and the crown 61 in which to move as a result of eccentricity but as illustrated when the spring finger heads 47, 48 engage the tapers leading to the constriction a driving motion along the path defined by the channels or paths 39 to 43 occurs. In such circumstances any engagement between the spring finger heads 47, 48 and the sides of the channels or passages 39, 40 will only create limited energy and friction braking with consequent energy loss progressively as the heads 47, 48 and therefore the orbit thread moves along the passage defined by the channels 39 and 40.

Figure 5:
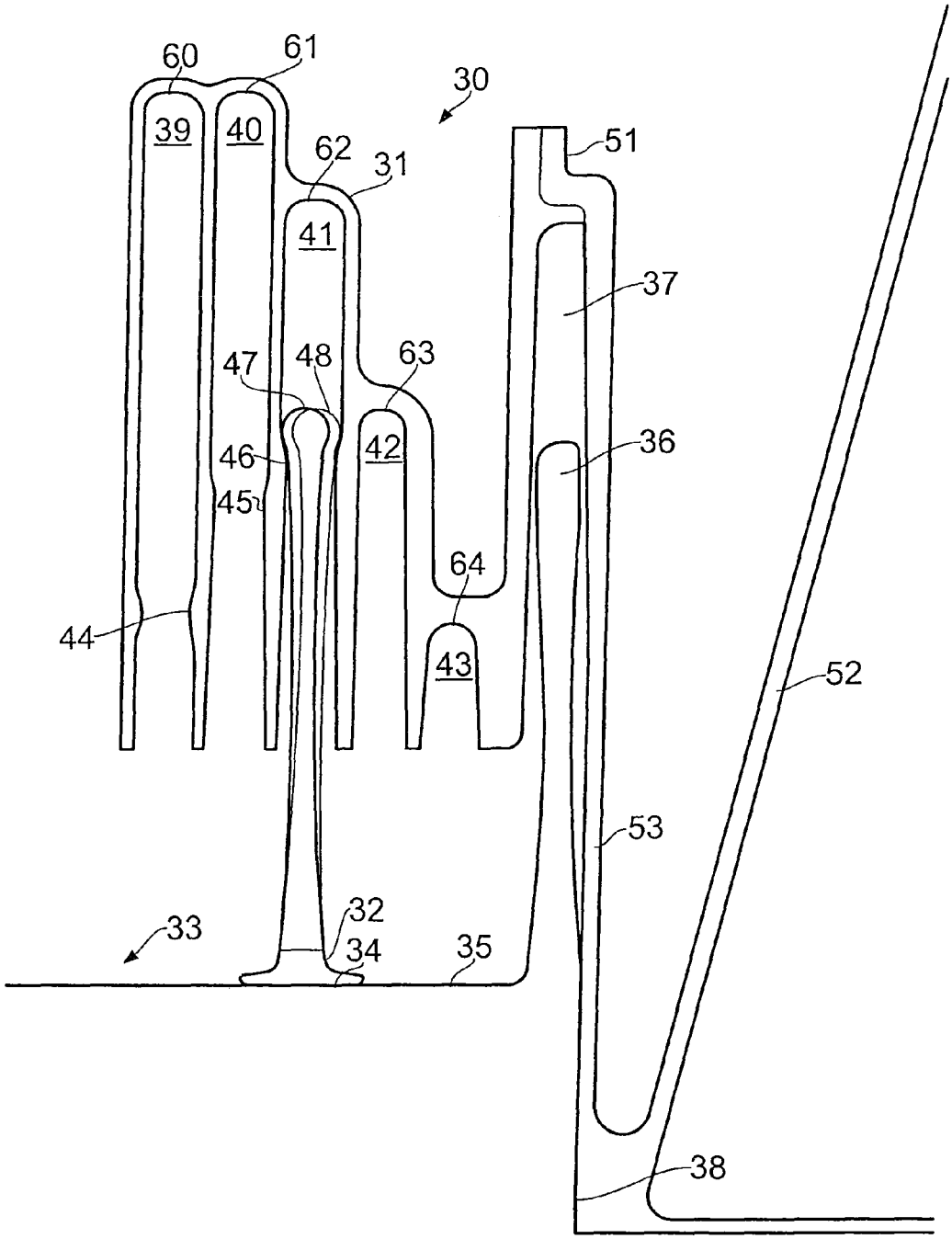
FIG. 5 is a part cross section of a stabiliser as depicted in FIGS. 2 to 4 at a third stage of deployment.

FIG. 5 illustrates a third stage of deployment in which again the spring finger heads 47, 48 have moved along the pathway defined from channel 40 to channel 41. In such circumstances the heads 47, 48 are progressively constrained between the taper surfaces defined by the crown 62 and the constriction 46. The ends 47, 48 again are driven along the fixed thread pathway with precessional rotation of the orbit thread in the form of bearing surface 34 on the surface 35 and movement to the right of bearing surface 34 along surface 35 so some energy is dissipated through the contact between the spring finger heads 47, 48 and parts of the channel 41 and in particular the constriction 46.

Figure 6:
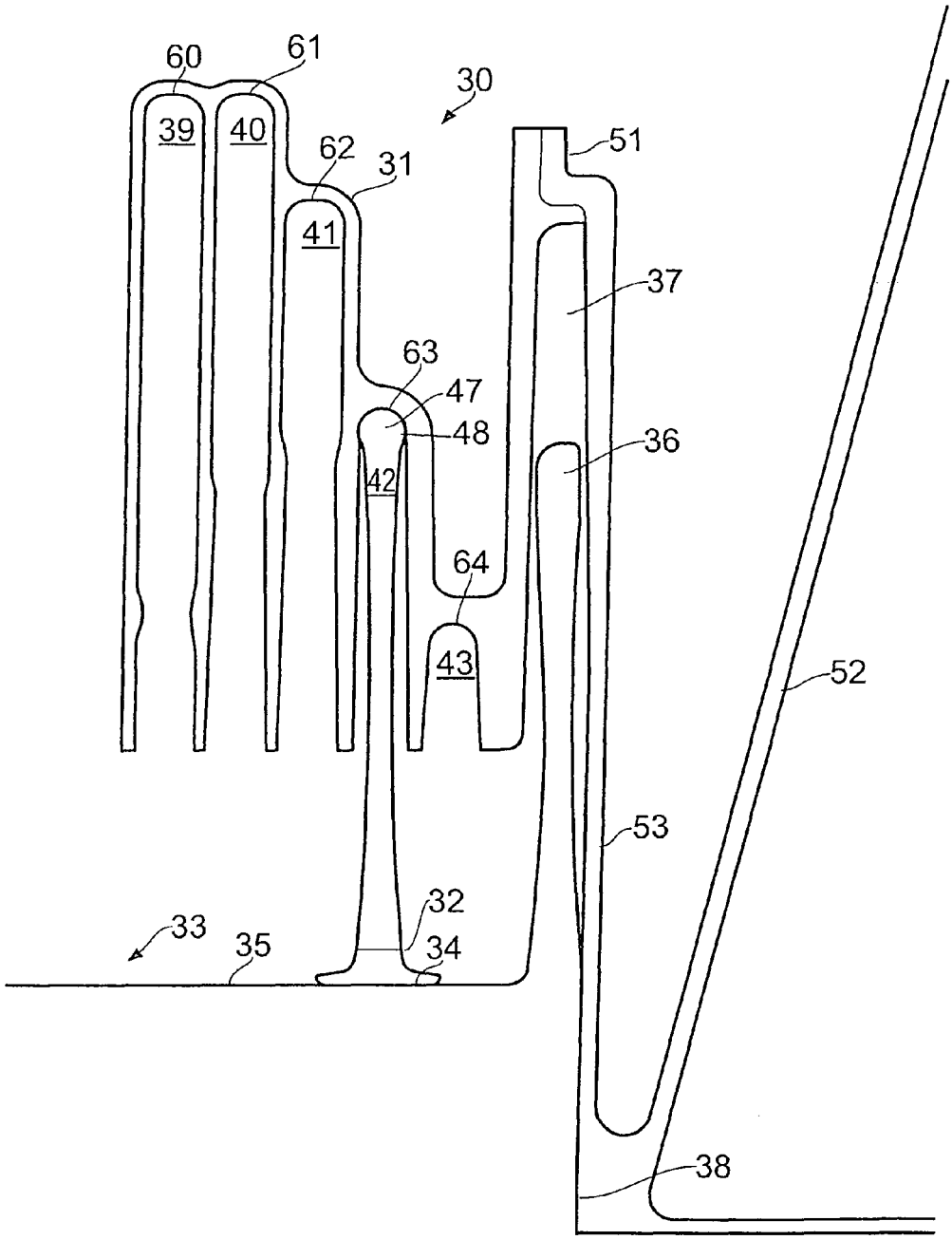
FIG. 6 is a part cross section of a stabiliser as depicted in FIGS. 2 to 5 at a fourth stage of deployment; and, FIG. 7 is a part cross section of a stabiliser at a final stage of deployment.

FIG. 6 illustrates a fourth stage of deployment of a stabiliser in accordance with aspects of the present invention. As can be seen the heads 47, 48 now engage the crown 63 in a plain thread which drives the orbit thread 32 to the bearing surfaces 34, 35 against the shaft resulting in centring. The heads 47, 48 are in continuous engagement with the crown 63 as most of the orbital speed and energy has now been dissipated and therefore quicker more direct centring can safely occur. Although there is significant crown contact load and device deflection (particularly in the mounting diaphragm) at this stage, the deflected shape is not shown in this figure.

Figure 7:
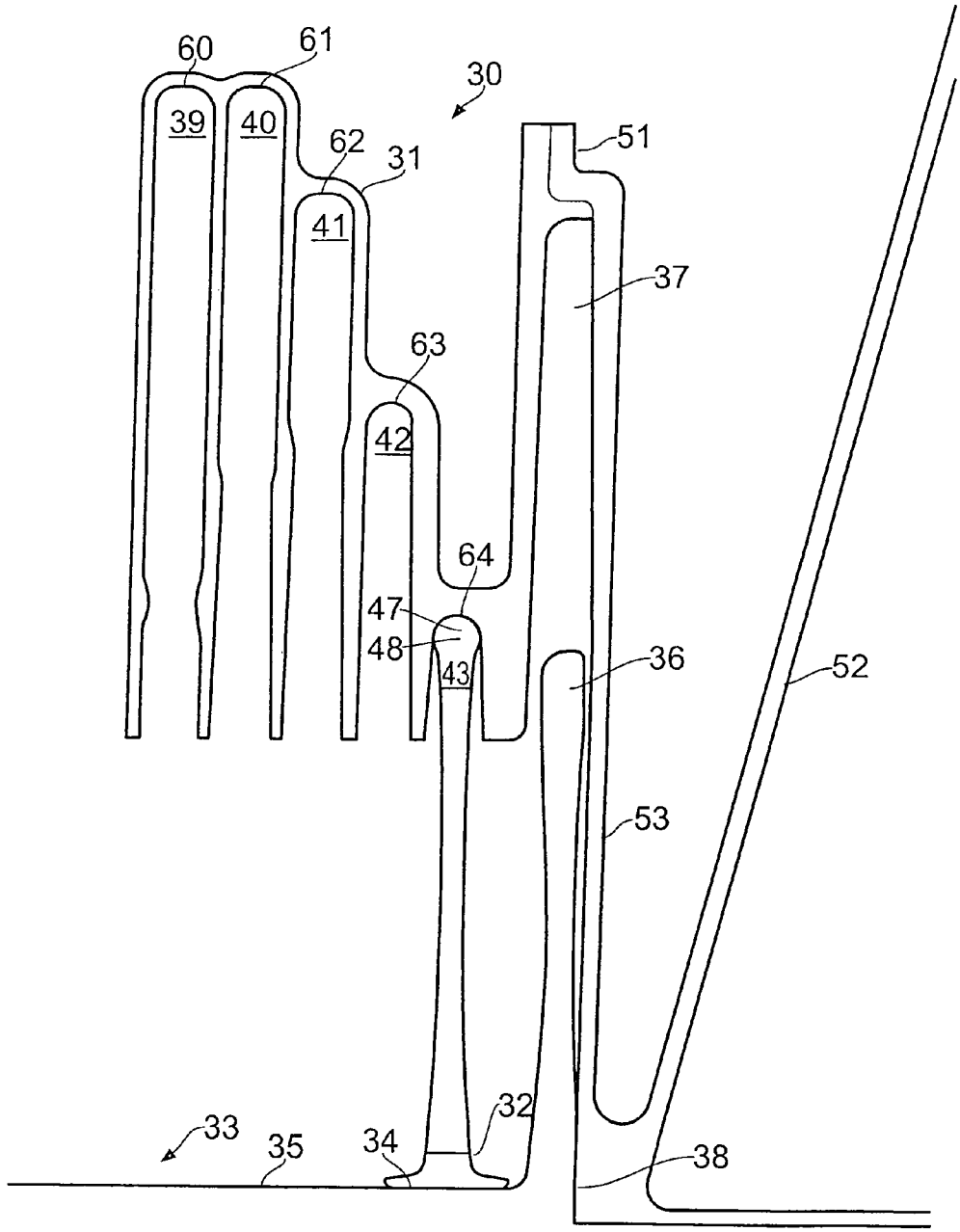

FIG. 7 illustrates the general final state of deployment of a stabiliser in accordance with aspects of the present invention so it will be noted that the spring finger heads 47, 48 are now within the channel or passage 43 such that through the orbit thread 32 and bearing surfaces 34, 35 centring has returned the whole arrangement to substantially the same state as depicted in FIG. 2 prior to deployment of the stabiliser according to aspects of the present invention. As indicated generally the stabiliser will only be deployed when there is an unbalance causing eccentric rotation. Such unbalance will typically occur in a blade loss situation with regard to a gas turbine engine which will result in high shear stresses applied to an appropriate fuse 38. The fuse 38 may comprise frangible elements which extend between parts of the stabiliser which break under shear loads.

Modifications and alterations to aspects of the present invention will be appreciated by those skilled in the art. It will be understood by providing thinner sections with regard to initial screw thread path 31 in channels 39, 40, 41 axial deflection of the fixed thread will be provided under the spring finger loads acting at the constrictions 44, 45, 46 so axial deflection may allow a small reduction in the axial stack length of grooves 39, 40, 41. Grooves 42 and 43 require thicker sections due to the relatively high loads from crown contact.

By aspects of the present invention a load transfer device is provided which may act as a limited torque variable ratio gearbox. By defining the orbit thread 32 as a single plane wheel driven as a planet gear in a variable radius carrier defined by a planar screw thread path 31 this screw thread path 31 becomes an annulus gear allowing transfer of power between the orbit element 32 and the screw thread path 31 defining a gearbox transfer assembly. Such a gearbox will be of a relatively low power density and efficiency capacity but nevertheless may prove advantageous.

The invention claimed is:

1. A shaft stabiliser for a gas turbine engine comprising a fixed screw thread path at least tapering in part and an orbit thread around a bearing carrier fixed to a bearing housing, the orbit thread is configured to move along the fixed screw thread path to centre the bearing carrier relative to an axis, the stabiliser characterised in that the fixed screw thread path is defined at least in part by a channel with a constriction and the orbit thread includes spring finger ends to engage the screw path, the constriction extends along the screw path to act within the channel against the spring finger ends of the orbit thread to vary engagement load to the orbit thread dependent upon position along the fixed screw thread path.

2. The stabiliser of claim 1 wherein a guide flange is associated with the bearing carrier and the guide flange is provided within a radially tapering slot in order to present the spring finger ends in the channel, the slot forms a diaphragm mount to soft mount the fixed thread for reduced loads under initial thread crown contact followed by a rising mount stiffness as the orbit thread runs home to maximise the final support stiffness and hence restore rotor bounce frequency.

3. The stabiliser of claim 1 wherein at least a part of the fixed screw thread path is arranged to provide a continuous load engagement to the orbit thread by constriction of the alternate spring finger ends of the orbit thread.

4. The stabiliser of claim 1, wherein the spring finger ends are bulbous parts comprising alternatively splayed fore and aft fingers.

5. A stabiliser of claim 1 wherein the fingers are sized to provide a degree of engagement load, through side face driving, tolerant of orbit size.

6. The stabiliser of claim 1 wherein the stabiliser incorporates a fuse element to restrain the bearing carrier.

7. The stabiliser of claim 6 wherein the fuse element is activated by an excess shear load.

8. The stabiliser of claim 1 wherein the constriction is initially configured low in the fixed thread with a more open parallel section above it to effect part orbit low radius slow speed driving.

9. The stabiliser of claim 1 wherein the orbit thread centres the bearing housing by a plain bearing surface and a controlling guide flange.

10. The stabiliser of claim 1 wherein the constriction raises or tapers upward in the channel.

11. A gas turbine engine incorporating the stabiliser of claim 1.

* * * * *